US008650836B2

(12) United States Patent
Albert et al.

(10) Patent No.: US 8,650,836 B2
(45) Date of Patent: Feb. 18, 2014

(54) FILM-TAIL SEALING SYSTEM AND METHOD FOR WRAPPING APPARATUS

(75) Inventors: Leonid M. Albert, Skokie, IL (US); Jeffrey G. Kellermann, Arlington Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 264 days.

(21) Appl. No.: 12/755,899

(22) Filed: Apr. 7, 2010

(65) Prior Publication Data

US 2010/0257816 A1 Oct. 14, 2010

Related U.S. Application Data

(60) Provisional application No. 61/169,162, filed on Apr. 14, 2009.

(51) Int. Cl.
*B65B 11/00* (2006.01)

(52) U.S. Cl.
USPC ..... 53/204; 53/409; 53/556

(58) Field of Classification Search
USPC ..... 53/204, 210, 375.8, 375.9, 409, 556, 53/558
See application file for complete search history.

(56) References Cited

U.S. PATENT DOCUMENTS

| | | | | |
|---|---|---|---|---|
| 5,282,347 | A * | 2/1994 | Cleine et al. | 53/204 |
| 5,755,083 | A * | 5/1998 | Cleine | 53/588 |
| 6,192,653 | B1 * | 2/2001 | Maekawa et al. | 53/204 |
| 6,247,294 | B1 * | 6/2001 | Suolahti | 53/588 |
| 6,305,145 | B2 * | 10/2001 | Suolahti | 53/64 |
| 6,446,418 | B1 * | 9/2002 | Maekawa et al. | 53/588 |
| 6,594,976 | B1 * | 7/2003 | Chikamitsu et al. | 53/589 |
| 2008/0168643 | A1 | 7/2008 | Albert et al. | |

FOREIGN PATENT DOCUMENTS

| | | | |
|---|---|---|---|
| EP | 1568638 | A1 | 8/2005 |
| GB | 2043021 | A * | 10/1980 |
| WO | 9519913 | A1 | 7/1995 |
| WO | 2007128885 | A1 | 11/2007 |
| WO | 2008085702 | A1 | 7/2008 |

OTHER PUBLICATIONS

International Search Report and the Written Opinion of the International Searching Authority issued in connection with PCT/US2010/030797 on Aug. 17, 2010.

* cited by examiner

*Primary Examiner* — Alexandra Elve
*Assistant Examiner* — Eyamindae Jallow
(74) *Attorney, Agent, or Firm* — Levenfeld Pearlstein, LLC

(57) ABSTRACT

A film-tail clamp, cut, and seal system for use in a wrapping apparatus for wrapping an associated item has an oval track vertically oriented and openable to move into and out of the associated item. A shuttle is configured for movement along an inner periphery of the track. A wrapping material is dispensed from the shuttle for wrapping around the item. A clamp arm, which is movable into and out of a plane defined by the film being wrapped around the item, has a sealing element for contacting and sealing a free end portion of the film onto a portion of the film already wrapped around the item. The clamp arm also has a clamp for securing the film when the film is sealed and has a cutter for cutting the free end portion of the film from the portion sealed onto the film.

14 Claims, 3 Drawing Sheets

FILM-TAIL SEALING SYSTEM AND METHOD FOR WRAPPING APPARATUS

CROSS-REFERENCE TO RELATED APPLICATION

This application claims the benefit of priority of Provisional U.S. Patent Application Ser. No. 61/169,162, filed Apr. 14, 2009, entitled "FILM-TAIL SEALING SYSTEM AND METHOD FOR WRAPPING APPARATUS".

BACKGROUND OF THE INVENTION

The present invention relates to a wrapping apparatus and more particularly to a wrapping material tail clamp, cut, and sealing system.

Many types of items are packaged in roll or coil form. For example, steel and aluminum sheet are often coiled for storage, transport, and handling. Such coils can be up to five to seven feet in diameter.

In order to protect and preserve the appearance of the steel or aluminum, the coils are typically wrapped with protective material in the form of a film. Such a film can be a single wrap of, for example, a low density polyethylene stretch film. The wrap can also include a fabric or other woven or non-woven material wrapped along with the polyethylene film.

One known machine for carrying out the wrapping process uses a specifically shaped track to carry a film dispensing shuttle through the eye of the coil, while the coil is slowly rotated on its axis on a set of block rollers. The complete body of the coil is effectively sealed by a cocoon of stretch film.

Generally, the machine has a heavy-duty, generally oval shaped track that provides the guide for the film-dispensing shuttle that travels around the inside of the track. The track has a hinged end section or track arm that pivots upwardly to open the track so that a lower portion of the track can be moved into the eye of the coil. The track is adjustable in the vertical plane to accommodate different coil diameters.

The track is typically movable on rails to advance into the eye of the coil. The machine can also be movable transverse to the direction of the track. Such a machine is commercially available from ITW Fleetwood-Signode of Glenview, Ill., under the name CoilMaster. One such wrapping system is described in Albert, et al. published U.S. Patent application, US Publication No. 2008-0168643, which disclosure is incorporated herein by reference.

The film dispensing shuttle includes one or more tractors and trailers that are designed to drive themselves around the track. The film is provided on the shuttle in rolls that have a finite amount of material wound thereon and as such require periodic replacement. Rolls may have to be replaced during the winding of a coil, or, conversely, a coil wrapping may be completed with film remaining on a roll. In either scenario, there are times when the film may have to be clamped, cut and sealed during the wrapping operation. To prevent the "tail" of the film from hanging from the coil, in known operations the tail is manually tucked into the wound film to prevent the tail from interfering with movement of the shuttle and to prevent unwrapping of the film. Other devices are known that seal the tail to the coil. While this may be effective, there is the opportunity for the film to become loose, thus compromising the integrity of the wrap.

Accordingly, there is a need for a system and method for clamping, cutting, and sealing the tail of the film. Desirably, such a system can effect this operation while a coil is on the wrapping machine. More desirably, such a system and method secures the film tail coming from the shuttle and prevents the film from slipping and unwrapping from the coil. More desirably still, such a system and method are used to clamp the film between itself and the shuttles, seal the film to the coil, and cut the film between the coil and itself. This holds the film (from the shuttles) at the end of the wrapping cycle to reduce the time and labor required to assure that a subsequent wrapping operation is carried out without undue labor.

BRIEF SUMMARY OF THE INVENTION

A film-tail clamp, cut, and seal system is configured for use in a wrapping apparatus for wrapping an associated item. The wrapping apparatus has an oval track vertically oriented and openable to move into and out of the associated item. The wrapping apparatus includes a shuttle configured for movement along an inner periphery of the track. A wrapping material, such as a film, is dispensed from the shuttle for wrapping around the item.

The film-tail clamp, cut, and seal system of the wrapping apparatus includes a clamp arm that is movable into and out of a plane defined by the film being wrapped around the item. The clamp arm also has a sealing element for contacting and sealing a free-end portion of the film onto a portion of the film wrapped around the item. The clamp arm includes a clamp for securing the film when the free-end of the film is sealed onto the portion of the film already wrapped around the item. The clamp also includes a cutter for cutting the free-end portion of the film from the portion sealed onto the film wrapped around the item. The clamp secures the film for a subsequent coil wrapping operation.

A second carriage is present for moving the clamp arm vertically toward and away from the item, within or parallel to the plane defined by the film being wrapped around the item. In addition, a third carriage may move the clamp arm horizontally toward and away from the item, within or parallel to the plane defined by the film being wrapped around the item.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

Figure 1:
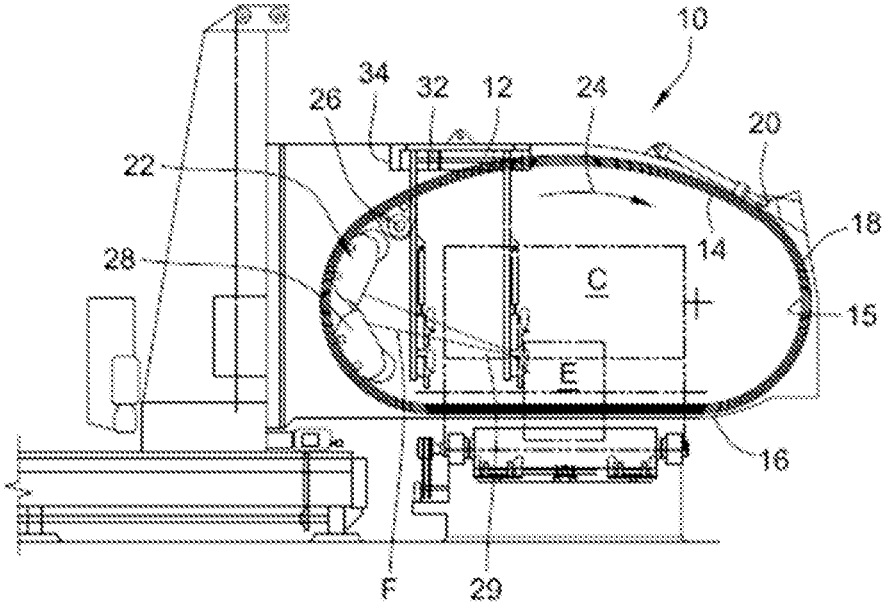
FIG. 1 is a side view of a wrapping apparatus having a film-tail sealing system in accordance with the principles of the present invention, the sealing system track shown in place in a center of a coil.
Figure 2:
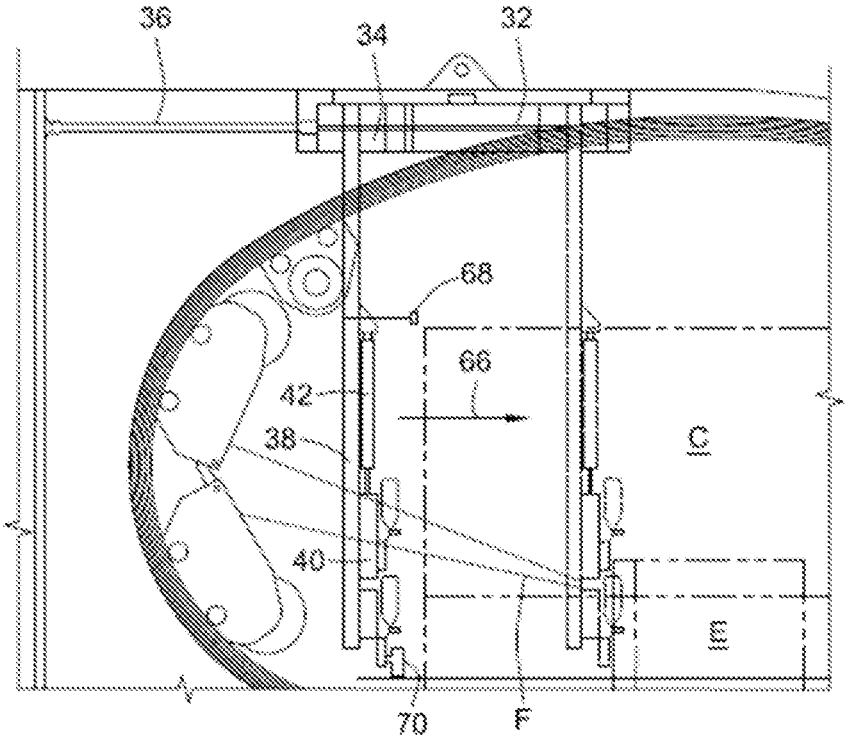
FIG. 2 is an enlarged, partial view of the top of the apparatus of FIG. 1.

Referring to the figures and in particular to FIG. 1, there is shown a wrapping apparatus or machine 10 having a film-tail sealing system 12 and carrying out a method for film-tail sealing embodying the principles of the present invention.

The machine 10 includes a track 14 having a generally oval shape. A lower portion 16 of the track 14 is cantilevered when a track arm 18 is open. An end (or the track arm 18) of the oval is hinged opposite of the base (with the hinge 20 at about the top of the track 14) to permit the track 14 to be opened to move the track into and out of the eye E of the coil C. When closed, the track arm 18 aligns with the lower portion 16 of the track 14. The inside or inner periphery 15 of the track 14, thus, defines the substantially continuous track 14. The track 14 moves up and down to accommodate coils C of different diameters.

A shuttle 22 is configured for movement along the inner periphery 15 of the track 14 in the direction indicated by the arrow at 24. The shuttle 22 includes a drive or tractor 26, and one or more film F dispensing cars or trailers 28 that are pulled along by the tractor 26. The trailers 28 can dispense polymer films, fabric or like wrapping member, collectively referred to as film or films F.

The machine 10 can include a change system (not shown) to permit removing the shuttle 22 from the track 14 and replacing the shuttle 22 with a ready, stand-by or replacement shuttle 22 with the track 14 in place in the eye E of the coil C. Such a change system is disclosed in the aforementioned published patent application to Albert et al., US Pub. No. 2008-0168643.

Figure 3:
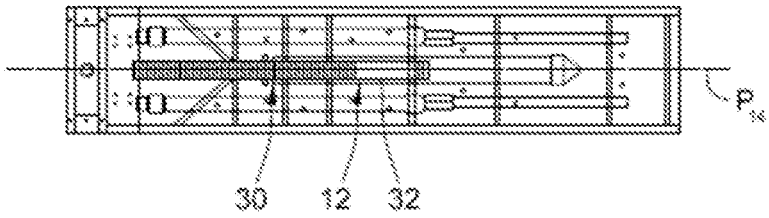
FIG. 3 is a top view of the wrapping apparatus showing the location of the sealing system.
Figure 4:
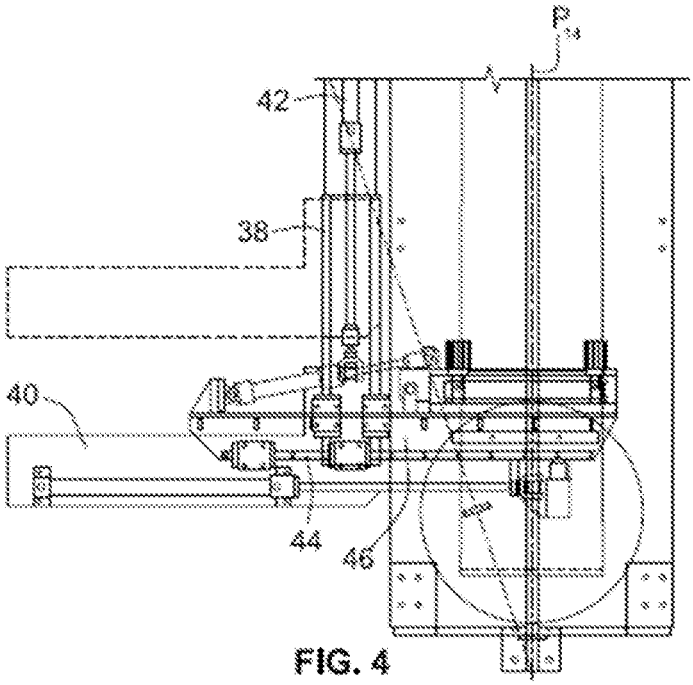
FIG. 4 is a view longitudinally along the wrapping system into the coil on the wrapping machine, as viewed from the left-hand side of FIG. 1.
Figure 5:
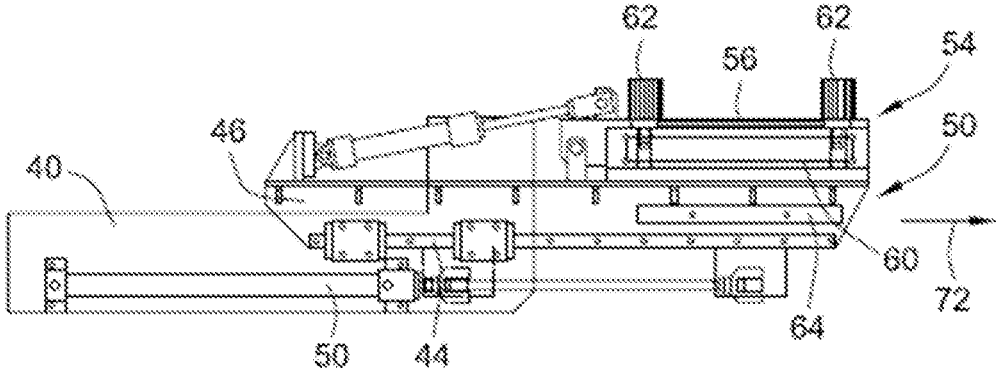
FIG. 5 is a view similar to FIG. 4 showing the wrapping system arm in the extended position.
Figure 6:
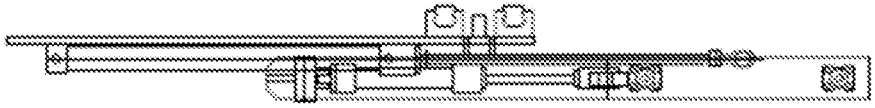
FIG. 6 is a top view of the arm of FIG. 5.

During coil C change-out, it is necessary to cut the film F and to clamp the film F so as to not "lose" the tail 29 of the film F that is attached to the shuttle 22 when preparing to commence a subsequent wrapping cycle. In addition, a "second" tail (from the coil C) is desirably sealed to the coil C to prevent the film F from unwrapping from the coil C. The present film-tail sealing system 12 effects the cutting, clamping and sealing operations. As illustrated in FIG. 3, the system 12 is mounted to the wrapping machine 10 at a side 30 of the machine 10. A frame 32 is mounted at about the top rail of the machine 10. A first main carriage 34 is mounted to the frame 32 to move horizontally along the frame 32 toward and away from the coil C (in the same direction of travel as the shuttle). Movement is effected by a main carriage cylinder 36 (such as a hydraulic cylinder). Other drives can be used as will be recognized by those skilled in the art.

The main or first carriage 34 carries a vertical track 38 and a second (or vertical) carriage 40 moves vertically (up and down) on the vertical track 38. Movement of the vertical carriage 40 is effected by a vertical carriage cylinder 42, such as a hydraulic cylinder, but again, other drives can be used as will be recognized by those skilled in the art.

A clamp track 44 is carried on the vertical (second) carriage 40 and a clamp carriage (also referred to herein as a "third carriage") 46 moves horizontally along the clamp track 44 into and out of the plane $P_{14}$ (see FIG. 3) of the shuttle track 14 (as viewed from the perspective of FIG. 1, into and out of the plane of the figure). Essentially, the clamp carriage 46 moves into and out of the path of the film F as it wraps around the coil C. Movement of the clamp carriage 46 is effected by a clamp carriage cylinder 50, such as a hydraulic cylinder, but again, other drives can be used as will be recognized by those skilled in the art.

Figure 7:
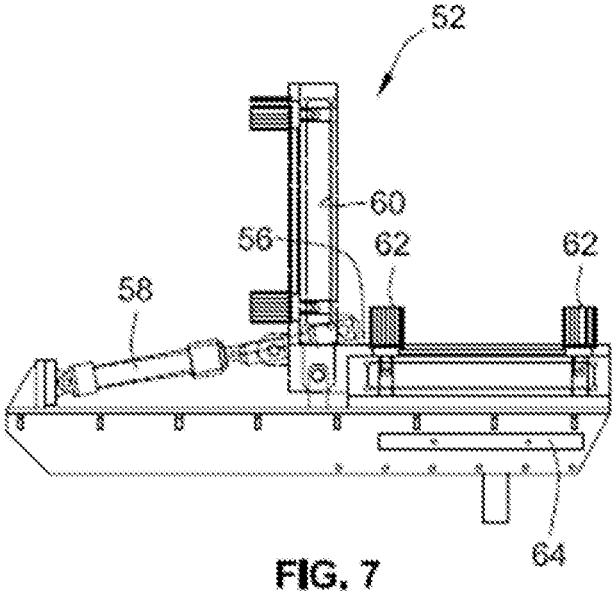
FIG. 7 is a view of the arm similar to FIG. 5 showing the clamp jaw in phantom in the open position and in solid lines in the closed position.

Referring to FIG. 7, the clamp carriage 46 is formed as a jaw 52 and has a clamp/cutter/sealer assembly 54 mounted thereto. A portion of the clamp/cutter/sealer assembly 54 is carried on a clamp arm 56 that pivots as seen in FIG. 7 between an open state (the clamp arm 56 pivoted up) and a closed or clamped state (the clamp arm 56 pivoted down). Movement of the clamp arm 56 is effected by a clamp arm cylinder 58, such as a hydraulic cylinder, but other drives can be used as will be recognized by those skilled in the art.

A blade 60 within the clamp arm 56 is configured to move (in a reciprocating motion) toward the clamped film F, to cut the film F. Blade 60 movement is effected by blade drive cylinders 62, such as a pneumatic cylinders or the like. Other drives can be used as will be recognized by those skilled in the art.

A sealing bar 64 is mounted to the clamp/cutter/sealer assembly 54 adjacent to the clamp arm 56. The sealing bar 64 is an electric heater element that is used to heat (and seal) the film F onto itself.

A typical operation sequence is as follow. A wrapping operation has completed—the shuttles 22 are at a home position (as seen in FIG. 1) and the film F is still attached to the shuttles 22 and coil C. The tail sealing system 12 is in the home position with the first main carriage 34 retracted (moved toward the shuttles 22), the vertical carriage 40 lowered down and the clamp carriage 46 retracted (away from the coil C). The clamp arm 56 is in the open position.

The clamp carriage 46 moves inward toward the center of the coil C (as indicated by the arrow at 72) so that the film F is disposed within the clamp jaw (with the jaw open). The first main carriage cylinder 36 is actuated to move the first main carriage 34 (and thus the clamp arm 56) toward the coil C as indicated by the arrow at 66. A sensor 68, such as a photoelectric proximity sensor, located on the clamp/cutter/sealer assembly 54 (in a present embodiment located on the vertical track 38) senses when the clamp arm 56 is near to the coil C edge. This also positions the sealing bar 64 at about the edge of the coil C and a limit switch 70 just inside the bore of the coil C (the limit switch 70 is just below the sealing bar 64).

The vertical carriage 40 (the second carriage) moves up until the limit switch contacts the inside edge of the coil C. This positions the sealing bar 64 at the proper location for sealing.

The first main carriage 34 moves inward toward the coil C so that the sealing bar 64 contacts the coil C (actually contacts the film F on the coil C) and compresses the film-tail 29 on the film F (that is wrapped around the coil C). A pressure transducer (not shown) can be used to determine that a proper pressure is achieved. The clamp arm 56 then closes to hold the film F in the clamp arm 56 and the sealing bar 64 is actuated (current is supplied to the sealing bar 64) to seal the film-tail 29 to the film F that is wrapped around the coil C. This seals the tail 29 to the coil C.

Following sealing of the tail 29 to the coil C, the cutter cylinders 62 are actuated to cut the film-tail 29 from the coil C. The blade 60 is positioned between the sealing bar 64 and the clamp arm 56 so that the wrapped coil C is then separable from clamp arm 56, but the film F (coming from the shuttles 22) remains clamped in the clamp arm 56.

The main carriage 34 retracts (moves away from the coil C), the vertical carriage 40 lowers down and the clamp carriage 46 moves of the plane of the machine track 14. The coil C can then be removed from the wrapping machine 10 and a new coil C placed in the machine 10 for wrapping. It will be appreciated that the film F has remained clamped in the clamp arm 56, and thus the wrapping machine 10 can commence wrapping a new coil C, with the film F secured, to effect proper wrapping of the coil C. Because the film F is held by the clamp arm 56, the film F will not slip from the coil C as wrapping commences.

The advantages of the present film-tail clamp, cut, and seal system 12 will be appreciated by those skilled in the art. The seal system 12 secures the free or tail end of the protective film F covering for a coil C of material, such as aluminum or steel sheet, while the coil C is on the wrapping machine 10. The present system 12 prevents the film F from slipping and unwrapping from the coil C, effectively clamping the film F between the clamp arm 56 and the shuttle 22, sealing the film F to the coil C, and cutting the film F between the coil C and the clamp arm 56. Holding the film F (from the shuttle 22) at the end of the wrapping cycle reduces the time and labor required to assure that a subsequent wrapping operation is carried out without undue labor.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A film-tail clamp, cut, and seal system for use in a wrapping apparatus for wrapping an associated item, the wrapping apparatus having an oval track vertically oriented and openable to move the track into and out of the associated item, the wrapping apparatus including a shuttle configured for movement along an inner periphery of the track and having a wrapping material dispensed therefrom for wrapping around the item, the film-tail clamp and seal system comprising:

a clamp arm movable into and out of a plane defined through and parallel to the oval track, the clamp arm having a sealing element for contacting and sealing a free end portion of the wrapping material onto a portion of the wrapping material wrapped around the item, the clamp arm having a clamp for securing the wrapping material when the wrapping material is sealed onto the portion of the wrapping material and the clamp arm having a cutter for cutting the free end portion of the wrapping material from the portion sealed onto the wrapping material wrapped around the item;

a first carriage for moving the clamp arm into and out of the plane defined through and parallel to the oval track; and a second carriage for moving the clamp arm toward and away from the item in a first direction within or parallel to the plane defined through and parallel to the oval track, the first and second carriages being movable perpendicular to one another.

2. The film-tail clamp, cut, and seal system of claim 1 including a third carriage for moving the clamp arm in a second direction toward and away from the item within or parallel to the plane defined through and parallel to the oval track, the second direction being different than the first direction.

3. The film-tail clamp, cut, and seal system of claim 1, wherein the sealing element is a heater element and the end of the wrapping material is heat sealed onto a portion of itself on the item.

4. The film-tail clamp, cut, and seal system of claim 1, wherein the cutter is a blade.

5. The film-tail clamp, cut, and seal system of claim 1, wherein the first carriage is mounted to a frame and moves along the frame carrying a vertical track, and wherein the second carriage travels on the vertical track carrying a clamp track, wherein a third carriage travels on the clamp track and carries the clamp arm on the third carriage.

6. The film-tail clamp, cut, and seal system of claim 1 including a limit switch.

7. The film-tail clamp, cut, and seal system of claim 1 including a sensor.

8. A wrapping apparatus of the type for wrapping an associated item, the wrapping apparatus having an oval track vertically oriented and openable to move into and out of the associated item, the wrapping apparatus including a shuttle configured for movement along an inner periphery of the track and having a wrapping material dispensed therefrom for wrapping around the item, the wrapping apparatus including a film-tail clamp, cut, and seal system, the film-tail clamp, cut, and seal system comprising:

a clamp arm movable into and out of a plane defined through and parallel to the oval track, the clamp arm having a sealing element for contacting and sealing a free end portion of the wrapping material onto a portion of the wrapping material wrapped around the item, the clamp arm having a clamp for securing the wrapping material when the wrapping material is sealed onto the portion of the wrapping material and the clamp arm having a cutter for cutting the free end portion of the wrapping material from the portion sealed onto the wrapping material wrapped around the item;

a first carriage for moving the clamp arm into and out of the plane defined through and parallel to the oval track; and a second carriage for moving the clamp arm vertically toward and away from the item within or parallel to the plane defined through and parallel to the oval track, the first and second carriages being movable perpendicular to one another.

9. The wrapping apparatus of claim 8 including a third carriage for moving the clamp arm horizontally toward and away from the item within or parallel to the plane defined through and parallel to the oval track.

10. The wrapping apparatus of claim 8, wherein the sealing element is an electric heater element and the end of the wrapping material is heat sealed onto a portion of itself on the item.

11. The wrapping apparatus of claim 8, wherein the cutter is a blade.

12. The wrapping apparatus of claim 8, wherein the first carriage is mounted to a frame and moves along the frame carrying a vertical track, and wherein the second carriage travels on the vertical track carrying a clamp track, wherein a third carriage travels on the clamp track and carries the clamp arm on the clamp carriage.

13. The wrapping apparatus of claim 8 including a limit switch.

14. The wrapping apparatus of claim 8 including a sensor.

* * * * *